United States Patent [19]

Margulies

[11] 4,387,832

[45] Jun. 14, 1983

[54] PRE-MOISTENED TOWELETTE DISPENSING PACKAGE INCLUDING FLEXIBLY ADJUSTABLE TIE DEVICE

[75] Inventor: Herman Margulies, South Orange, N.J.

[73] Assignee: Sterling Drug Inc., New York, N.Y.

[21] Appl. No.: 237,585

[22] Filed: Feb. 24, 1981

[51] Int. Cl.[3] ..... A47K 10/38

[52] U.S. Cl. ..... 221/63; 206/210

[58] Field of Search ..... 221/63, 304, 307, 50, 221/47, 45, 64; 206/210; 229/63; 150/9, 11; 24/30.5 T, 30.5 P, 30.5 R

[56] References Cited

U.S. PATENT DOCUMENTS

| | | | |
|---|---|---|---|
| 408,625 | 8/1889 | Johnson | 206/63.3 |
| 1,185,813 | 6/1916 | McCorkindale et al. . | |
| 1,201,963 | 11/1916 | Hill . | |
| 1,664,164 | 3/1928 | Endter . | |
| 2,340,090 | 1/1944 | Vineburgh . | |
| 2,731,997 | 1/1956 | Muth et al. | 150/11 |
| 3,243,082 | 3/1966 | Thompson | 221/307 X |
| 3,908,822 | 9/1975 | Giberstein . | |
| 3,920,179 | 11/1975 | Hall | 150/11 |
| 3,994,417 | 11/1976 | Boedecker . | |
| 4,004,687 | 1/1977 | Boone . | |
| 4,017,002 | 4/1977 | Doyle et al. . | |
| 4,180,160 | 12/1979 | Ogawa et al. . | |
| 4,244,493 | 1/1981 | Harrison | 221/63 |
| 4,267,868 | 5/1981 | Lowe | 150/11 |

*Primary Examiner*—Stanley H. Tollberg

*Attorney, Agent, or Firm*—Wenderoth, Lind & Ponack

[57] ABSTRACT

A package for dispensing and separating single sheets from a continuous web of pre-moistened sheets which are joined at perforations includes a continuous web of premoistened sheets, and a bag which may but need not be found within a container, surrounding the web. The bag is open at a top end portion thereof, and an end sheet of the web extends through the open top end portion. A flexible tie device is positioned to surround the end sheet of the web and the top end portion of the bag and gathers and substantially seals the bag around the end sheet of the web. The flexible tie device causes sufficient friction between the top end portion of the bag and the end sheet to enable the end sheet to tear from the next sheet of the web at the perforations therebetween when the end sheet is withdrawn. The flexible tie device is adjustable to enable selective alteration to adjustment of the size of the opening through the opened top end portion of the bag and the end sheet.

9 Claims, 4 Drawing Figures

PRE-MOISTENED TOWELETTE DISPENSING PACKAGE INCLUDING FLEXIBLY ADJUSTABLE TIE DEVICE

BACKGROUND OF THE INVENTION

The present invention relates to a package including a flexibly adjustable tie device for use in dispensing and separating single sheets from a continuous web of pre-moistened sheets which are joined at perforations.

Pre-moistened sheets or towelettes are increasingly popular among consumers because they are convenient and easily provide a "damp cloth" even when water is not readily available. Generally, these sheets are either individually wrapped or come as part of a continuous web which is perforated so that it can be separated into a plurality of individual sheets. The present invention relates to the dispensing of single sheets or towelettes packaged as a continuous web. Generally, towelettes of this type are delivered to the consumer in a plastic container with a separable top removably fitted over the container. The top has a specifically designed outlet for withdrawing the towelettes on the web therethrough and for sequentially separating the individual towelettes from the web. Previous efforts to provide a simple withdrawing and tearing construction have generally been directed to the manner of formation of the opening through which the towelettes pass as they are removed from the web. The opening must be large enough to permit the towelettes to fit therethrough and, at the same time, must be small enough to exert enough frictional pull on the towelettes to cause them to separate along the perforated dividing lines. Such prior art towelette dispensers do however generally have the drawbacks that the materials required for forming the package are expensive, considerable manual labor costs are required for manufacture, and disposal of the spent container is a problem. Many of the prior art containers which are presently available are made of extruded and molded plastic having a top with the specific type of outlet therethrough positioned above the container with the web inside. It is required that the web be initially fed through the opening so that it is ready to be used. Also, the dispensing opening must be conveniently sealed in some manner to prevent the pre-moistened towelettes from drying out before reaching the consumer. The fact that the containers are of rigid plastic creates a disposal problem, since they are bulky even when empty and they create polluting fumes when they are burned.

One previous attempt to overcome such prior art disadvantages is disclosed in U.S. Pat. No. 4,244,493, issued Jan. 13, 1981, and assigned to the assignee of the present application. This previous arrangement discloses a package for dispensing and separating single sheets from a continuous roll of pre-moistened sheets which are joined at perforations. The package includes a container for housing therein a continuous roll of pre-moistened sheets, and a bag positioned within the container and surrounding the roll, the bag being open at a top end portion thereof, and an end sheet of the roll extending therethrough. A dispensing plate is separate from and positioned within the container and surrounds the end sheet of the roll and the top end portion of the bag. Such dispensing plate gathers and substantially seals the bag around the end sheet of the roll. Thus, the end sheet of the roll is dispensed through the top end portion of the bag, with the dispensing plate by gathering the top end portion of the bag around the end sheet of the roll creating sufficient friction therebetween to cause the end sheet to tear from the next sheet on the roll at the perforations therebetween when the end sheet is drawn out.

While this previous arrangement substantially overcomes the prior art disadvantages and operates quite effectively, it does have certain drawbacks. Thus, the dispensing plate employed has a relatively complicated configuration and is somewhat expensive to manufacture. Additionally, since the dispensing plate has therein only a single dispensing opening, if the friction provided by this single opening is not relatively exact, then the dispensing and separating of the towelettes will not be precise, and cannot be adjusted. Thus, if the dispensing opening in the dispensing plate provides insufficient friction, then the end sheet of the roll may not separate, or may separate with too much of the next sheet exposed outwardly of the bag, thereby presenting the disadvantage that such next sheet may dry out if not immediately used. On the other hand, if the dispensing opening in the dispensing plate provides too much friction, then the end sheet may become separated before the tip end of the next sheet is exposed through the bag.

SUMMARY OF THE INVENTION

With the above discussion in mind, it is an object of the present invention to provide a pre-moistened towelette dispensing package including a flexibly adjustable tie device for dispensing and separating single sheets from a continuous web of pre-moistened sheets which are joined at perforations, wherein it is possible to overcome the prior art disadvantages and to readily prevent the web of pre-moistened towelettes from drying out.

It is a further object of the present invention to provide such a dispensing package which represents an improvement over the package disclosed in U.S. Pat. No. 4,244,493, issued Jan. 13, 1981, whereby it is possible to easily selectively adjust the friction to which the towelettes are subjected during dispensing thereof, and whereby it is possible to avoid the expense and inflexibility of a dispensing plate having therein only a single dispensing opening.

These objects are achieved in accordance with the present invention by the provision of a package for dispensing and separating single sheets from a continuous web of pre-moistened sheets which are joined at perforations, such package including a continuous web of pre-moistened sheets, and bag means, the bag means surrounding the web and being open at a top end portion thereof, and an end sheet of the web extending through such open top end portion. A flexible tie device is positioned to surround the end sheet of the web and the top end portion of the bag means. The flexible tie device gathers and substantially seals the top end portion of the bag means around the end sheet of the web such that a dispensing opening is formed at the top end portion of the bag means through which the end sheet may be dispensed. During the dispensing action, the flexible tie device provides sufficient friction between the top end portion of the bag means and the web to cause the end sheet of the web to automatically tear above the dispensing opening from the next sheet of the web at the perforations therebetween when the end sheet is drawn from the bag means so as to leave at least a portion of the leading end of the next sheet exposed for grasping and subsequent dispensing. The tie device is flexibly adjustable to enable selective adjustment or alteration of the size of the dispensing opening in the top end portion of the bag means and of the friction imparted by the top end portion of the bag means to the sheets. The bag means is preferably formed of a moisture-proof or impermeable material. Therefore, and due to the fact that the tie device gathers and substantially seals the top end portion of the bag means around the end sheet of the web, the web is prevented from the drying between uses of the package.

The bag means with the web of pre-moistened sheets therein can be housed in a container which is provided with an opening adjacent the dispensing opening in the top end portion of the bag means for removal of the pre-moistened sheets therethrough. The container for housing the bag means can be of any construction, for example, such as described in U.S. patent application Ser. No. 950,616, filed Oct. 12, 1978, and assigned to the assignee of the present application. If desired, the container can be constructed for re-use with refill bags of pre-moistened sheets. Alternatively, instead of a container for housing the bag of pre-moistened sheets, the bag means can include a tube-like insert which surrounds the web of pre-moistened sheets. As described hereinbelow any resistance to the flow of the web in the bag means during withdrawal of an end sheet of the web therefrom which would result in premature separation of the end sheet from the next sheet of the web is to be avoided. The tube-like insert functions to protect the web of sheets from crushing forces being brought to bear thereon sufficient to cause premature separation of the end sheet from the next sheet of the web, when the bag means is grasped by the consumer during the dispensing operation or during storage or shipping. The insert can be of any suitable shape but preferably conforms generally to the shape of the flexible bag means in expanded form, and has at least one open end to permit withdrawal therethrough of the web of sheets. The insert can be constructed of any suitable material, preferably a resilient material, which will resist crushing when grasped by a consumer or during storage or shipping, for example, plastic conveniently having a gauge of about 10 to 14 mils. The insert can be pre-formed, e.g., by molding, into an appropriately dimensioned fixed shape, or alternatively, if a resilient material such as plastic of appropriate gauge is employed, the insert can be formed from an appropriately dimensioned rectangular sheet of the resilient material by rolling the sheet into a cylinder which, when inserted in the flexible bag means will tend to conform to and maintain the shape of the bag means due to the tendency of the material, by reason of its resiliency, to resume its original planar form.

The tie device may be any type of member which is flexible and which may be selectively manually adjusted to alter or adjust the size of the opening through the top end portion of the bag means and the amount of friction imparted thereby to the sheets during withdrawal thereof. In a preferred embodiment of the present invention, the flexible tie device according to the present invention may be a rubber band, a length of string, etc.

The continuous web can be packaged in the bag means in various forms, the only criterion being that during withdrawal from the bag means of the end sheet of the web, any resistance to the flow of the web in the bag means is insufficient to result in separation of the end sheet from the next sheet of the web below the dispensing opening at the top end portion of the bag means, i.e., any resistance to the flow of the web in the bag means should be insufficient to result in premature separation of the end sheet from the next sheet of the web so as to preclude passage of the leading end of the next sheet of the web through the dispensing opening. The continuous web can be, for example, in the form of a roll, or it can be folded or pleated, or it can be inserted in the bag means in a random manner. Conveniently the web is in the form of a coreless roll from the central void of which the web may be readily withdrawn.

BRIEF DESCRIPTION OF THE DRAWINGS

Other objects, features and advantages of the present invention will be made apparent from the following detailed description, taken with the accompanying drawings, wherein.

DETAILED DESCRIPTION OF THE INVENTION

Figure 3:
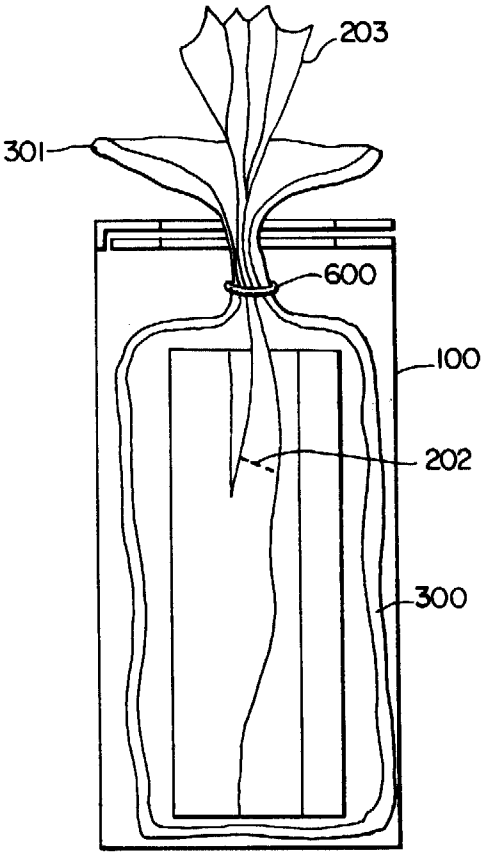
FIG. 3 is a view similar to FIGS. 1 and 2, but of an alternative embodiment of the present invention.

Initially, it is to be noted that like reference numerals are employed to designate like elements in the various figures of the drawings.

To aid in understanding the present invention, description will first be made, with reference to FIG. 1, of a previous dispensing package according to U.S. Pat. No. 4,244,493, issued Jan. 13, 1981. Thus, the dispensing package of FIG. 1 includes an outer container 100 for holding therein roll 200 of pre-moistened towelettes or sheets. The roll 200 within the container 100 is surrounded by a bag 300 which aids in preventing the roll from drying out. The top end portion 301 of the bag is open to allow an end sheet 203, joined at perforations 202 to the next sheet of the roll to be withdrawn from the bag. A dispensing plate 400 has therein a dispensing opening, and the plate 400 slides around and contains within the dispensing opening both the end sheet or towelette 203 and the top end portion 301 of the bag 300. The dispensing plate thus gathers and substantially seals the bag around the end sheet of the roll. The dispensing plate causes the top end portion of the bag to impart friction to the end sheet. Thus, as the end sheet 203 is withdrawn from the bag, the end sheet will separate from the next sheet at the perforations 202 therebetweeen, with the leading portion of the next sheet exposed through the top end portion of the bag.

Figure 1:
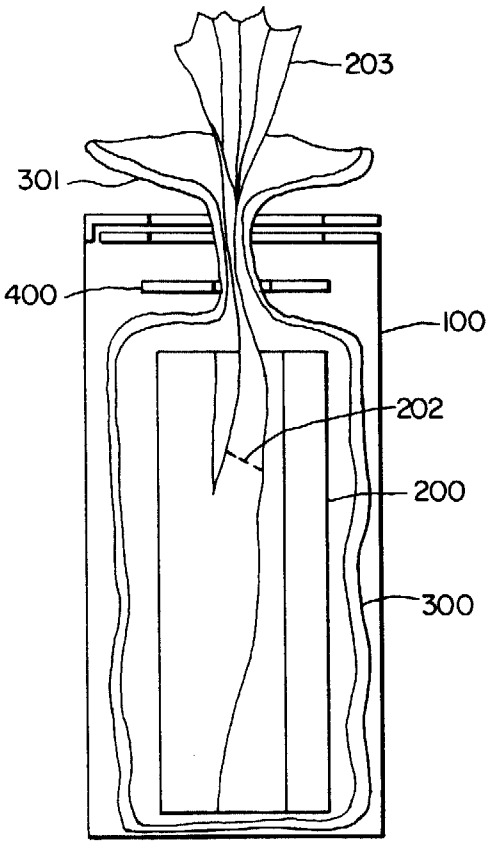
PRIOR ART FIG. 1
FIG. 1 is a somewhat schematic sectional view of a prior art dispensing package according to U.S. Pat. No. 4,244,493, issued Jan. 13, 1981.

It will be apparent that in the previous arrangement shown in FIG. 1, if the size of the dispensing opening in dispensing plate 400 is not precise, the dispensing operation may not occur with maximum efficiency, and the size of the dispensing opening in plate 400 is of course not adjustable. Thus, if the size of the dispensing opening in dispensing plate 400 is too large, then there will be too little fraction, and the end sheet 203 may not become separated at perforations 202. Alternatively, separation may occur, but at a position such that too much of the next sheet is exposed through the top end portion of bag. This would of course cause such next sheet to loose its moisture unless dispensed relatively quickly. On the otherhand, if the dispensing opening in dispensing plate 400 is too small, then the friction will be too great, with the result that separation of the end sheet may occur before a sufficient portion of the next sheet is exposed through the top end portion of the bag.

The above drawbacks of the previous arrangement as shown in FIG. 1 are overcome in accordance with the present invention. A preferred arrangement of the present invention is illustrated in FIG. 2.

Figure 2:
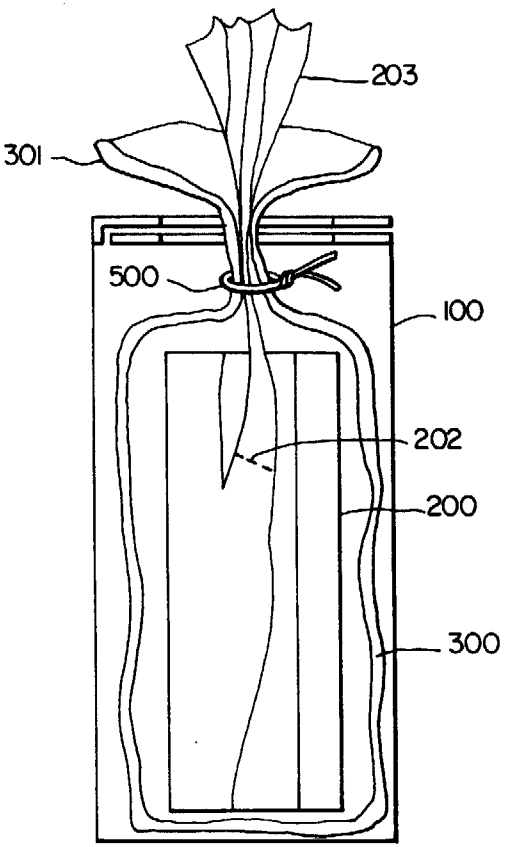
FIG. 2 is a view similar to FIG. 1, but of a preferred embodiment of the present invention.

Thus, the package of the present invention according to FIG. 2 includes container 100, roll 200 and bag 300 similar to the previous arrangement shown in FIG. 1.

However, rather then employing the dispensing plate 400 of the previous arrangement, the present invention employs a flexibly adjustable tie device 500 which operates in a manner similar to the dispensing plate 400 of FIG. 1 to surround the end sheet 203 and the top end portion 301 and to gather and substantially seal the bag around the end sheet. However, in accordance with the present invention the tie device 500 is flexibly adjustable to enable selective alteration or adjustment of the size of the opening through the opened top end portion 301 and of the friction imparted by the top end portion 301 against the end sheet 203.

In accordance with the embodiment of FIG. 2, the flexibly adjustable tie device 500 is a wire tie of the type conventionally employed to close and seal bakery packages. Thus, the ends of the wire tie 500 may be manually selectively twisted more or less to increase or decrease the amount of friction between the top end portion 301 of the bag and the end sheet 203 of the roll. This makes it possible for a consumer to very precisely adjust or "fine tune" the specific dispensing characteristics and performance of a given package.

It is specifically intended that container 100, roll 200 and bag 300 be any such known devices capable of performing the functions defined herein, and specifically may be such a elements as disclosed in U.S. Pat. No. 4,244,493, issued Jan. 13, 1981.

Container 100 may be of any construction suitable to contain the roll 200. For ease and assembly in disposal, a small paper box which is treated to be moisture resistent is adequate. Thus, a container which is lightweight, yet sturdy, and which will increase the ease of handling and stacking the rolls is provided.

The bag 300 for containing the roll 200 functions primarily to prevent the pre-moistened towelettes from drying out before they reach the consumer and before the consumer uses all of them. To fullfill this function, any lightweight, flexible plastic bag will be satisfactory. However, any other material which will inhibit vaporation of the moistening liquid in the roll may be used for the bag.

The actual roll 200 of towelettes is a continuous web which is perforated at 202 along the length thereof to form a plurality of sheets or towelettes 203 which can be separated from the remainder of the roll by simply detaching along the perforations. The technique of forming such a roll 200 is known. As described hereinbefore, other forms of continuous web also can be employed.

With reference now to FIG. 3 of the drawings an alternative embodiment of the present invention will be described. This embodiment of the dispensing package of the present invention corresponds to that of FIG. 2, except that the wire tie 500 is replaced by a rubber band 600. The rubber band 600 is flexibly adjustable to manually selectively alter or adjust the size of the opening through the opened top end portion and the amount of friction imparted by the top end portion 301 to the end sheet 203. Such adjustment may be achieved by simply looping the rubber band 600 a greater number or lesser number of times around the top end portion 301 and end sheet 203. By such type of adjustment, the performance and characteristics of a particular dispensing package may be selectively adjusted or "fine tuned".

Figure 4:
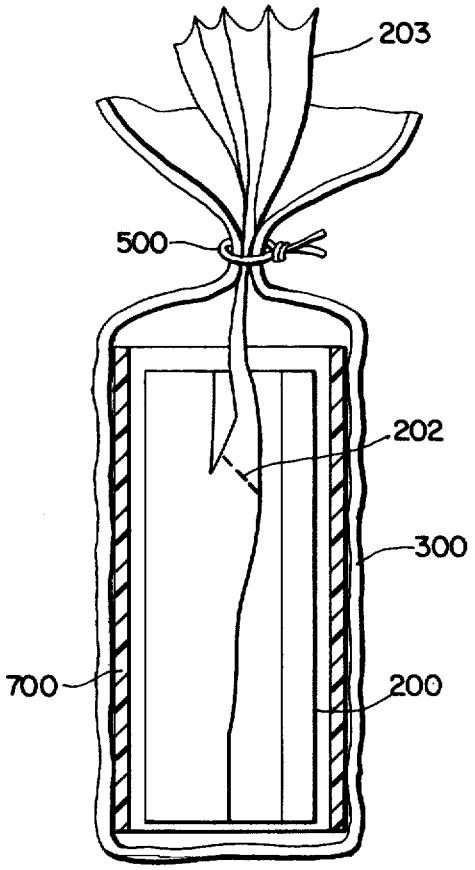
FIG. 4 is a view similar to FIGS. 1–3, but of a still further embodiment of the present invention.

With reference now to FIG. 4 of the drawings, a further embodiment of the present invention will be described. Thus, in this embodiment of the invention, the container 100 of the previous embodiments is not provided. The roll 200 of perforated sheets is positioned within bag 300. However, in this embodiment of the invention, there is provided a tubular member or a tube-like insert 700 which is positioned within the interior of bag 300 to surround the roll 200. The member 700 functions to protect the roll of sheets from crushing forces being brought to bear thereon sufficient to cause premature separation of the end sheet 203 from the next sheet of the roll, for example when the package is grasped by the consumer during the dispensing operation, or during storage or shipment of the package. Flexibly adjustable tie device 500 is provided in a manner identical with the arrangement described above regarding the embodiment of FIG. 2.

Although the present application has specifically described two particular embodiments of the flexibly adjustable tie device of the present invention, i.e. the wire tie 500 of FIGS. 2 and 4 and the rubber band 600 of FIG. 3, it is to be understood that various other devices may be employed, as will be understood by those skilled in the art. Thus, the flexibly adjustable tie device could easily be in the form of a length of string or twine, etc. The important feature of the present invention is that the tie device be flexible and capable of selective manual adjustment to alter or adjust the amount of friction between the top end portion 301 of the bag and the end sheet of the roll, to thereby precisely control and "fine tune" the dispensing performance and characteristics of a given dispensing package.

From the above discussion it will be apparent that the dispensing package according to the present invention overcomes the disadvantages of prior art arrangements, since in accordance with the present invention dispensing and separating of single sheets from a continuous web of pre-moistened sheets is made possible, while at the same time the web of sheets is effectively sealed to prevent loss of moisture thereof. Additionally, however, it will be apparent from the above discussion that the present invention offers a significant improvement over the previous dispensing package illustrated in FIG. 1, in that the dispensing performance and characteristics of a particular package may be precisely adjusted and "fine tuned" to the desires of a given consumer.

Although the present invention has been described and illustrated with respect to particularly preferred embodiments thereof, it is to be understood that such is not intended to be restrictive of the scope of the present invention, but that various modifications as would be understoood by those skilled in the art may be made without departing from the scope of the present invention.

What is claimed is:

1. A package for dispensing and separating single sheets from a continuous web of pre-moistened sheets, said package comprising:

a continuous web of pre-moistened sheets which are joined at perforations;

bag means surrounding the web and being open at a top end portion thereof, and an end sheet of the web extending through the open top end portion; and flexible tie means surrounding the end sheet of the web and the top end portion of the bag means, the tie means gathering and substantially sealing the top end portion of the bag means around the end sheet of the web and forming a dispensing opening at the top end portion of the bag means for dispensing the end sheet therethrough, the tie means providing sufficient friction at the dispensing opening between the top end portion of the bag means and the web to cause the end sheet of the web to automatically tear above the dispensing opening from the next sheet of the web at the perforations therebetween when the end sheet is drawn through the dispensing opening, the tie means being accessible to be flexibly adjustable to enable selective alteration of the size of the dispensing opening at the open top end portion of the bag means and selective adjustment of the friction.

2. A package as claimed in claim 1, wherein the tie means comprises a wire tie.

3. A package as claimed in claim 1, wherein the tie means comprises a rubber band.

4. A package as claimed in claim 1, wherein the continuous web of pre-moistened sheets is in the form of a roll.

5. A package as claimed in claim 1, further comprising a tubular member positioned within said bag means and surrounding said web for protecting said web.

6. A package for dispensing and separating single sheets from a continuous web of pre-moistened sheets, said package comprising:

container means for housing therein a continuous web of pre-moistened sheets which are joined at perforations ;

bag means positioned substantially within the container means and surrounding the web, the bag means being open at a top end portion thereof, and an end sheet of the web extending through the open top end portion; and flexible tie means surrounding the end sheet of the web and the top end portion of the bag means, the tie means gathering and substantially sealing the top end portion of the bag means around the end sheet of the web and forming a dispensing opening at the top end portion of the bag means for dispensing the end sheet therethrough, the tie means providing sufficient friction at the dispensing opening between the top end portion of the bag means and the web to cause the end sheet of the web to automatically tear above the dispensing opening from the next sheet of the web at the perforations therebetween when the end sheet is drawn through the dispensing opening, the tie means being accessible to be flexibly adjustable to enable selective alteration of the size of the dispensing opening at the open top end portion of the bag means and of the friction.

7. A package as claimed in claim 6, wherein the tie means comprises a wire tie.

8. A package as claimed in claim 6, wherein the tie means comprises a rubber band.

9. A packaged as claimed in claim 6, wherein the continuous web of pre-moistened sheets is in the form of a roll.

* * * * *